US005242092A

United States Patent [19]

Riis et al.

[11] Patent Number: 5,242,092

[45] Date of Patent: Sep. 7, 1993

[54] VALVE ARRANGEMENT FOR TRANSPORTABLE CONTAINER FOR STORING AND DISTRIBUTING LIQUID UNDER PRESSURE

[75] Inventors: Ken Riis; Per K. Augustinus, both of Odense, Denmark

[73] Assignee: Micro Matic A/S, Odense SV, Denmark

[21] Appl. No.: 828,935

[22] PCT Filed: Aug. 23, 1990

[86] PCT No.: PCT/DK90/00216

§ 371 Date: Mar. 31, 1992

§ 102(e) Date: Mar. 31, 1992

[87] PCT Pub. No.: WO91/02694

PCT Pub. Date: Mar. 7, 1991

[30] Foreign Application Priority Data

Aug. 24, 1989 [DK] Denmark ..... 4182/89
Feb. 6, 1990 [DK] Denmark ..... 1997/90

[51] Int. Cl.[5] ..... B65D 83/14

[52] U.S. Cl. ..... 222/400.7; 137/322; 222/402.1; 222/402.15

[58] Field of Search ..... 222/400.7, 400.8, 402.1, 222/402.15; 137/212, 315, 322; 251/149.4, 149.6

[56] References Cited

U.S. PATENT DOCUMENTS 4,411,287 10/1983 Hyde ..... 137/315
4,541,658 9/1985 Bartholomew ..... 251/149.6 X
5,054,743 10/1991 Norkey et al. ..... 251/149.6
5,069,424 12/1991 Dennany, Jr. et al. ..... 251/149.6

FOREIGN PATENT DOCUMENTS 0056295 7/1982 European Pat. Off. .
0317301 5/1989 European Pat. Off. .
0327373 8/1989 European Pat. Off. .
2005506 8/1988 Spain .
2188040A 9/1987 United Kingdom .

*Primary Examiner*—Andres Kashnikow
*Assistant Examiner*—J. A. Kaufman
*Attorney, Agent, or Firm*—Oliff & Berridge

[57] ABSTRACT

A valve arrangement is so adapted that it can be used for a transportable container (1) for storing and distribution of a liquid under pressure from a propellant gas. The arrangement comprises a stub (2) secured in an opening upwardly in the container (1) and a double valve (12) with both a gas and a liquid passage (33, 35). The valve (12) substantially consists of a valve housing (3), which can be detachably mounted in the stub (2), as well as a riser pipe part (15), which is mounted co-axially with an upper reception area in the valve housing (3) and which can be displaced from an upper closed valve position to a lower open valve position against the pressure of a spring (10). The riser pipe part (15) can moreover be displaced additionally a distance downwardly from the lower open valve position to a lower bottom position. Further, the riser pipe part (15) mounts an obliquely downwardly and outwardly protruding finger (42) with a lower free end part (44), which is so spaced from the top and axis of the riser pipe part (15) that the valve (12) can only be dismounted completely in or in the vicinity of the bottom position of the riser pipe part (15). This prevents damage which might occur if unauthorized persons should try to dismount the valve (12) before the gas pressure in the container (1) has been completely relieved.

3 Claims, 12 Drawing Sheets

Figure 1:
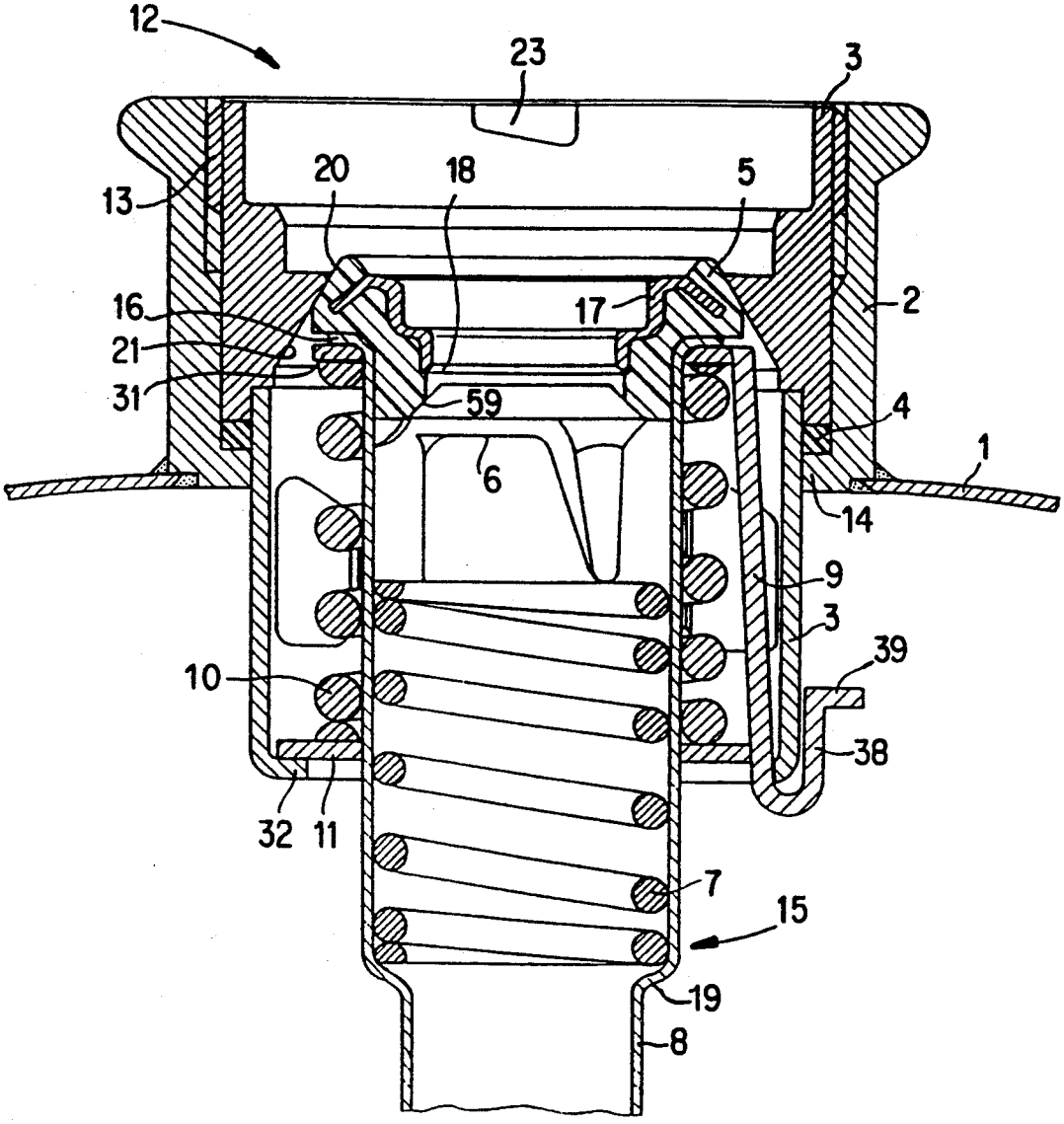

VALVE ARRANGEMENT FOR TRANSPORTABLE CONTAINER FOR STORING AND DISTRIBUTING LIQUID UNDER PRESSURE

The invention concerns a valve arrangement in particular for a transportable container of the type serving to store and distribute a liquid under pressure from a propellant gas, said arrangement comprising a ring-shaped stub secured in an opening upwardly in the container and a double valve having both a blockable gas passage and a blockable liquid passage and substantially consisting of a valve housing, which can be detachably mounted in the stub, and a riser pipe part arranged co-axially with an upper reception area in the valve housing such that said riser pipe part can be displaced axially from an upper closed valve position to a lower open valve position against the pressure from a spring mounted in the valve housing.

Today many different types of liquid, e.g. beverages, or liquids such as concentrates and plant protection agents, are stored and distributed in transportable containers under pressure from a propellant gas. For this purpose each container is provided with a double valve which both has a passage for the gas supply and a passage for propelling the liquid out of the container under the action of the gas pressure. This valve is generally mounted in a stub which is secured in an opening upwardly in the container, and in some cases this mounting takes place merely by means of a simple threaded connection, involving the risk that the valve can cause considerable damage since it can be readily dismounted before the gas pressure in the container has been fully relieved, and will then be ejected to the surroundings with great force by this pressure immediately when the threads disengage. In other cases the valve is mounted or adapted so that it cannot fully or partly be removed completely from the container before the pressure in it has been relieved, whereby the above-mentioned risk is essentially eliminated. However, all of these known arrangements suffer from the drawback that they have a complicated structure and are therefore expensive to manufacture, and to this should be added that mounting and dismounting of them is moreover cumbersome and time-consuming.

The object of the invention is to provide a valve arrangement of the type mentioned in the opening paragraph which cannot be removed completely from the container before the pressure in it has been relieved, and which additionally has a simpler and cheaper structure and can be mounted and dismounted more easily and rapidly than known before.

This is achieved in that the valve arrangement of the invention is characterized in that the riser pipe part can be displaced additionally a distance axially downwardly from the lower open position to a lower bottom position, and that the riser pipe part mounts an outwardly protruding finger with a free end part so spaced from the top and axis of the riser pipe part that a mounted valve cannot be dismounted completely in any of the positions of the riser pipe part, except in and in the vicinity of the bottom position. Such arrangements normally have a special coupling head, which can be fixed in the valve or on the stub, and which thereby connects the valve with partly a pressure gas source, partly a liquid dispensing location. When the coupling head is activated, an axially displaceable spindle in the head forces the riser pipe part downwardly so that the gas passage opens, while a valve plug in the riser pipe part is pressed downwardly so that the liquid passage opens. The above-mentioned safety mechanism operates by means of a direct continuation of this downwardly directed movement and therefore constitutes a simple and inexpensive structure, which also has the advantage that it is easy and rapid to operate. Nevertheless, it is impossible for unauthorised persons to dismount a valve completely, since this requires a special tool which is adapted for precisely this task, and which is not available to ordinary users.

In a particularly simple and advantageous embodiment of the invention, the finger can extend in an obliquely downwardly and outwardly extending direction from the riser pipe part and upwardly be secured to a ring which is fixed between the compression spring and an outwardly directed collar provided upwardly on the riser pipe part.

Moreover, according to the invention, the free end part of the finger may be so spaced from the top and axis of the riser pipe part that, when it is attempted to dismount the valve, it abuts the underside of the stub in all positions of the riser pipe part, except in and in the vicinity of the bottom position, whereby the end part effectively blocks the valve passage through the opening of the stub if a person who does not have the above-mentioned special tool tries to dismount the valve.

A particularly expedient structure is obtained in this connection when the finger downwardly has a U-shaped bend which is terminated with a stop member protruding substantially radially outwardly from the axis of the riser pipe part.

In another advantageous embodiment of the invention, the finger may consist of an elastic material, such as corrosion-resistant spring steel with a biassed spring force forcing the free end part of the finger out towards the inner side of a lower part of the valve housing wall; a catch may be arranged in an opening at this location of the wall, said catch downwardly having an inwardly directed projection and being capable of tilting about the lower edge of the opening between a first position where the upper outer edge of the catch protrudes so far from the wall of the housing that, when it is attempted to dismount the valve, it abuts the underside of the stub in all positions of the riser pipe part, except in and in the vicinity of the bottom position, and a second position where the outer side of the catch is substantially flush with the outer side of the wall, said finger having such a length that its free end part rests against the inner side of the catch in all riser pipe part positions and thereby tilts the catch out to its first position, except in and in the vicinity of the bottom position where the free end part treads on the inwardly directed projection on the catch and thereby tilts it inwardly to its second position. This embodiment provides the special advantage that it is possible to mount the valve by means of ordinary mounting tools since the catch is automatically pressed into its first position during assembly, the biassed spring pressure of the finger being overcome, while afterwards the valve can only be dismounted if a special tool capable of forcing the riser pipe part down to the bottom position is available.

In a particularly simple and effective structure according to the invention, the above-mentioned catch may have the shape of a U in a substantially vertical section, said U having two flaps directed outwardly with respect to the axis of the valve and a bottom plate forming the inner side of the catch, and the inwardly directed projection may consist of an edge which is bent inwardly downwardly on the bottom plate, while the tiltable bearing of the catch may consist of cutouts which are provided in the lower edges of the outwardly directed flaps and serve, in mounted state, to receive part of the lower edge of the valve wall opening.

Figure 2:
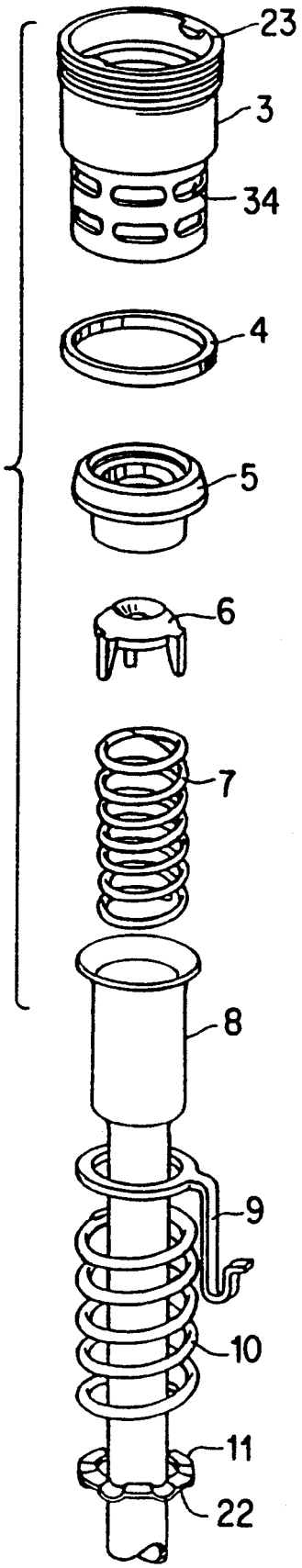
Figure 3:
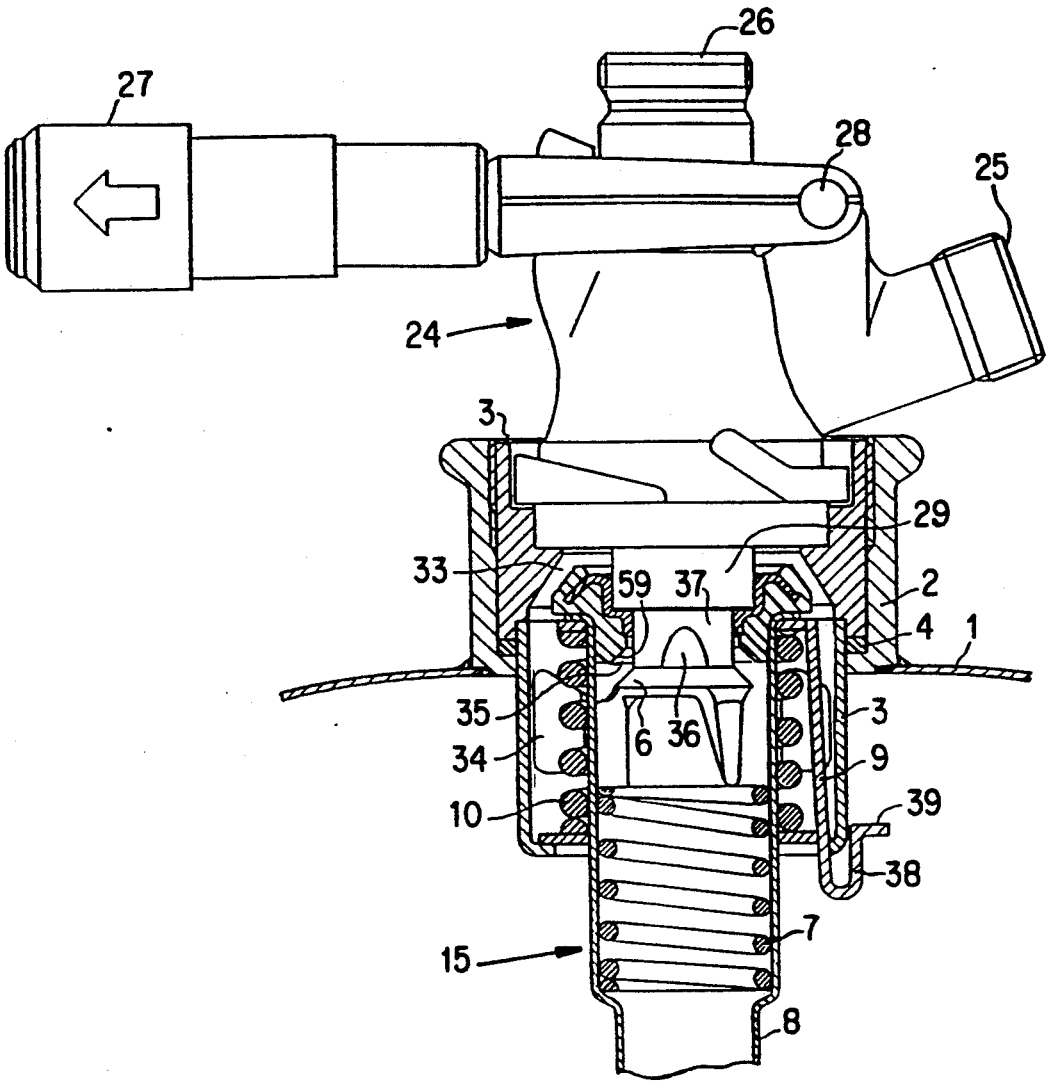
Figure 4:
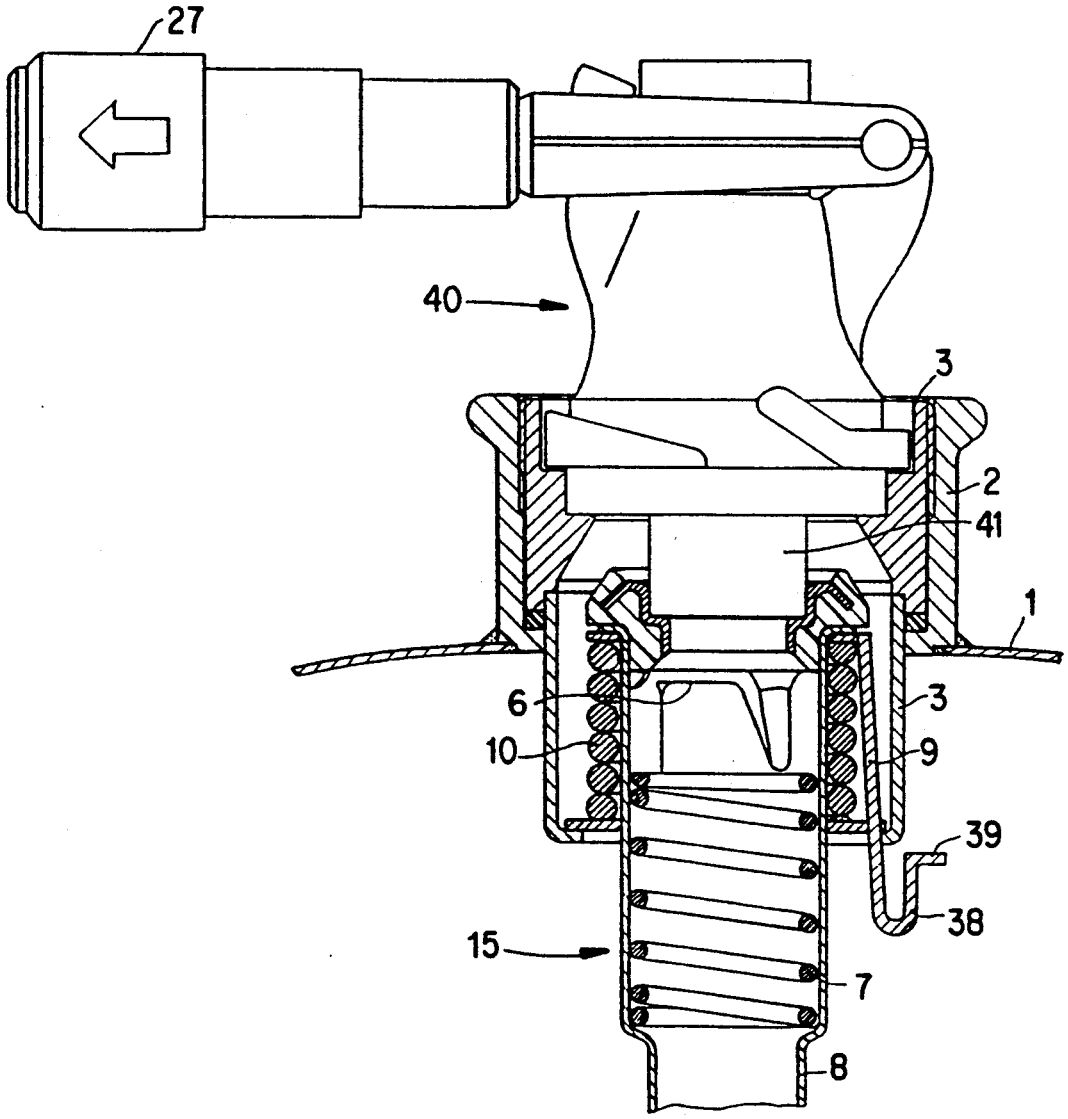
Figure 5:
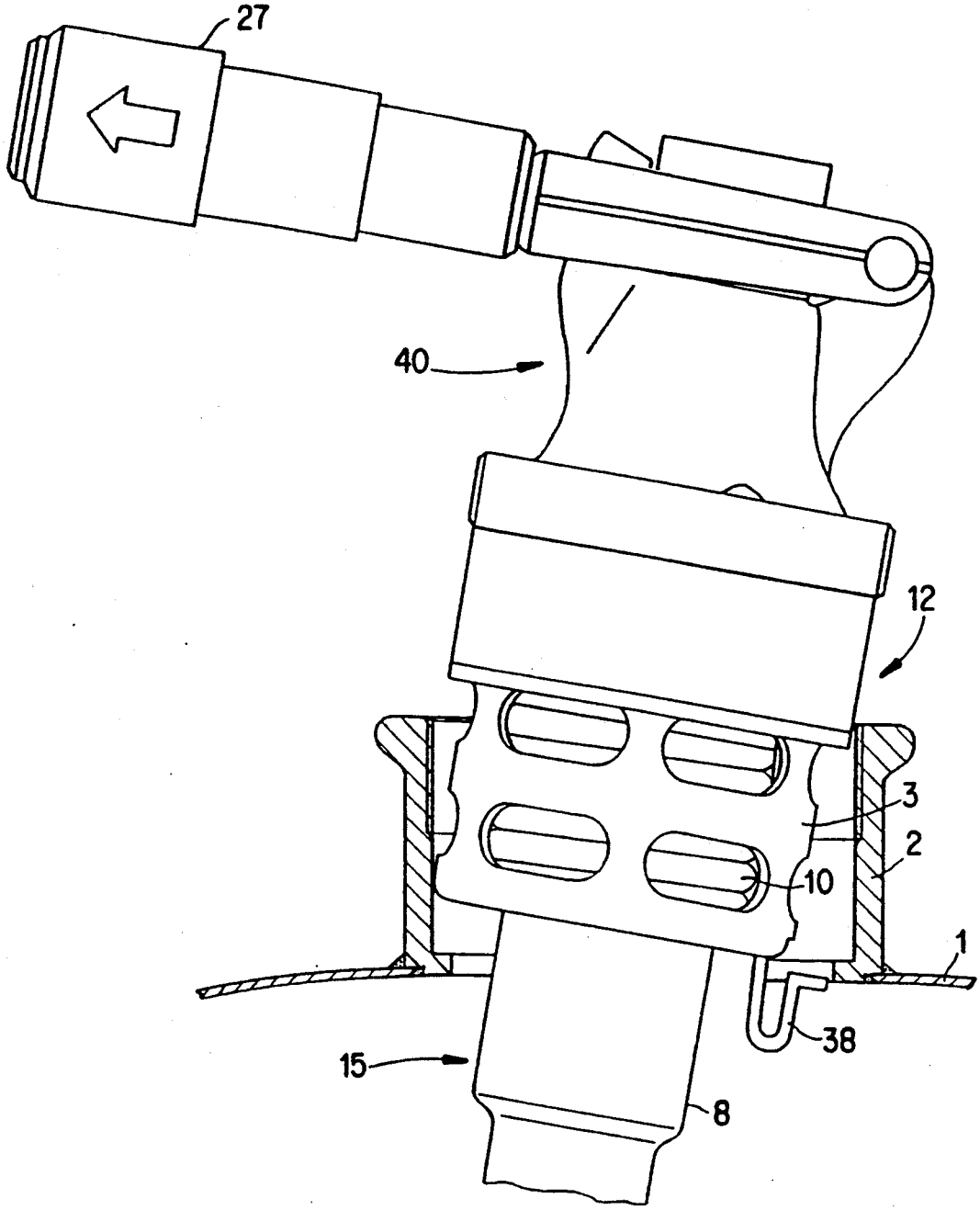
Figure 6:
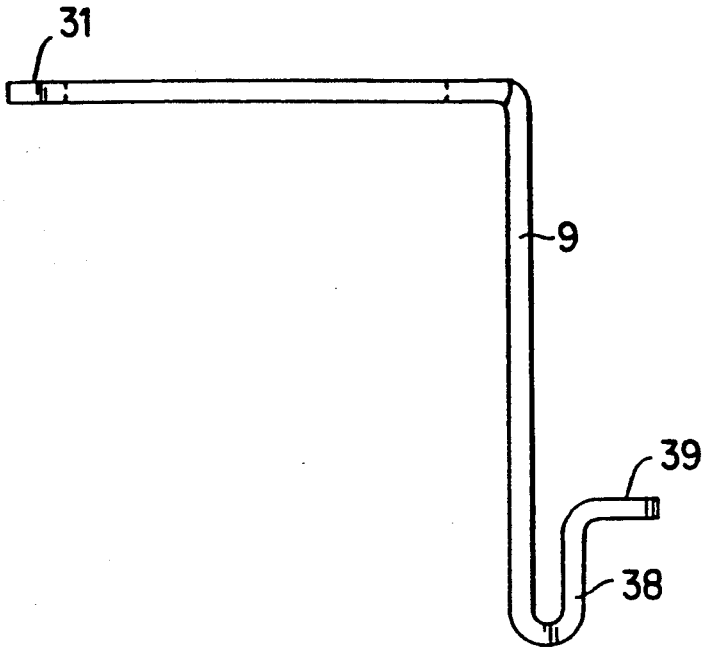
Figure 7:
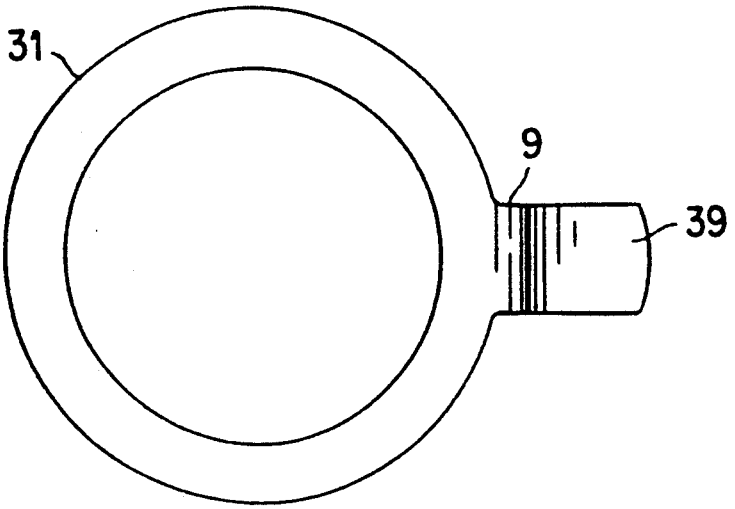
Figure 8:
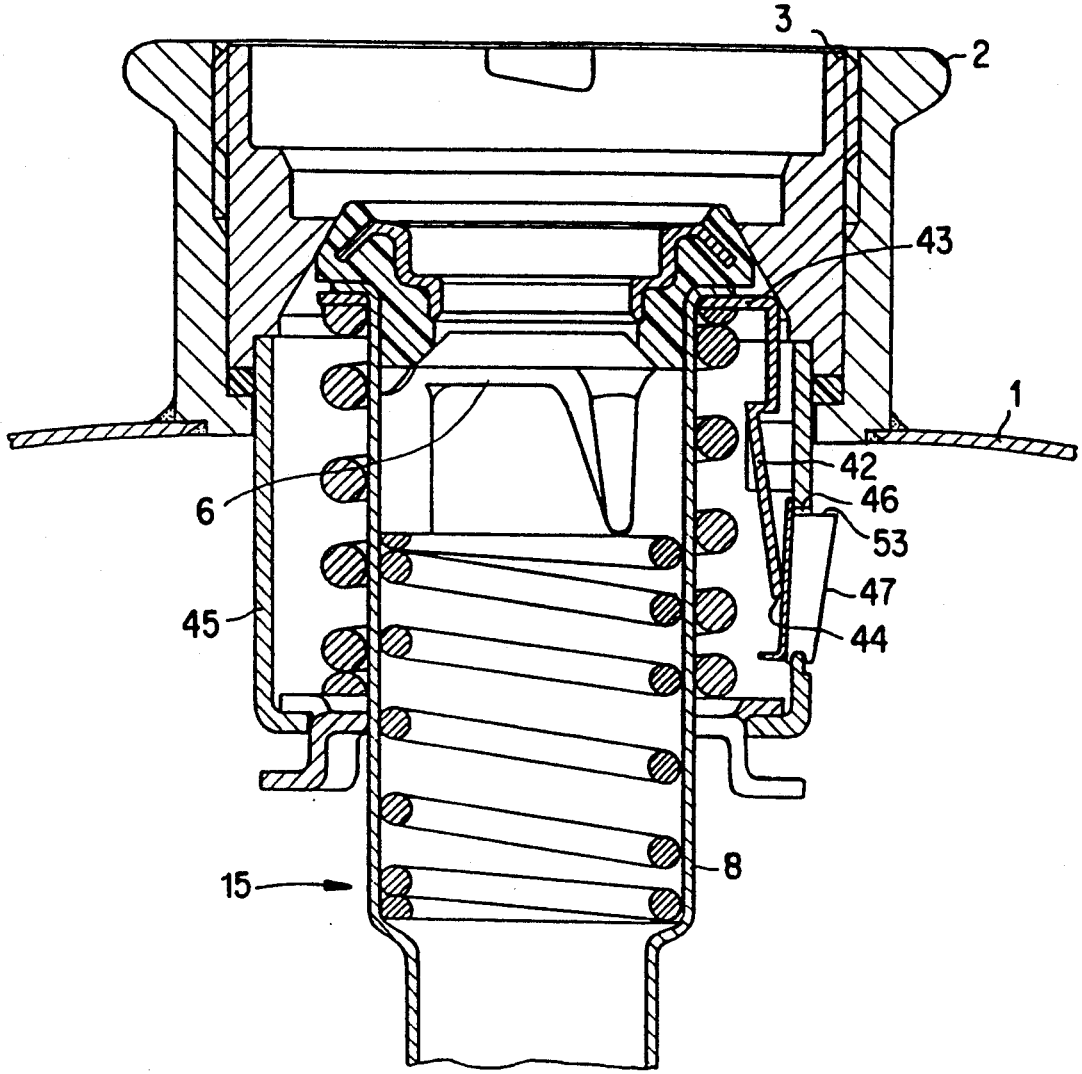
Figure 9:
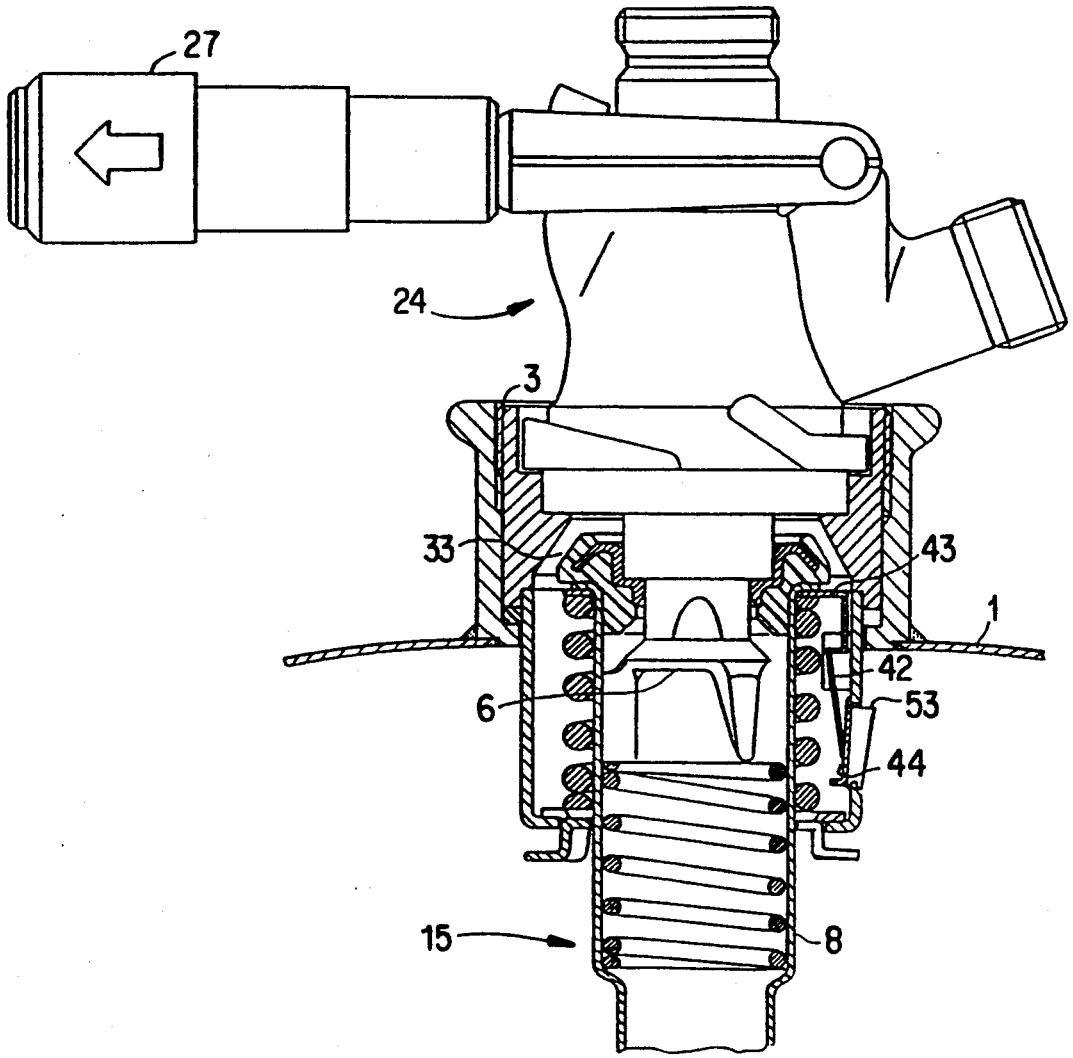
Figure 10:
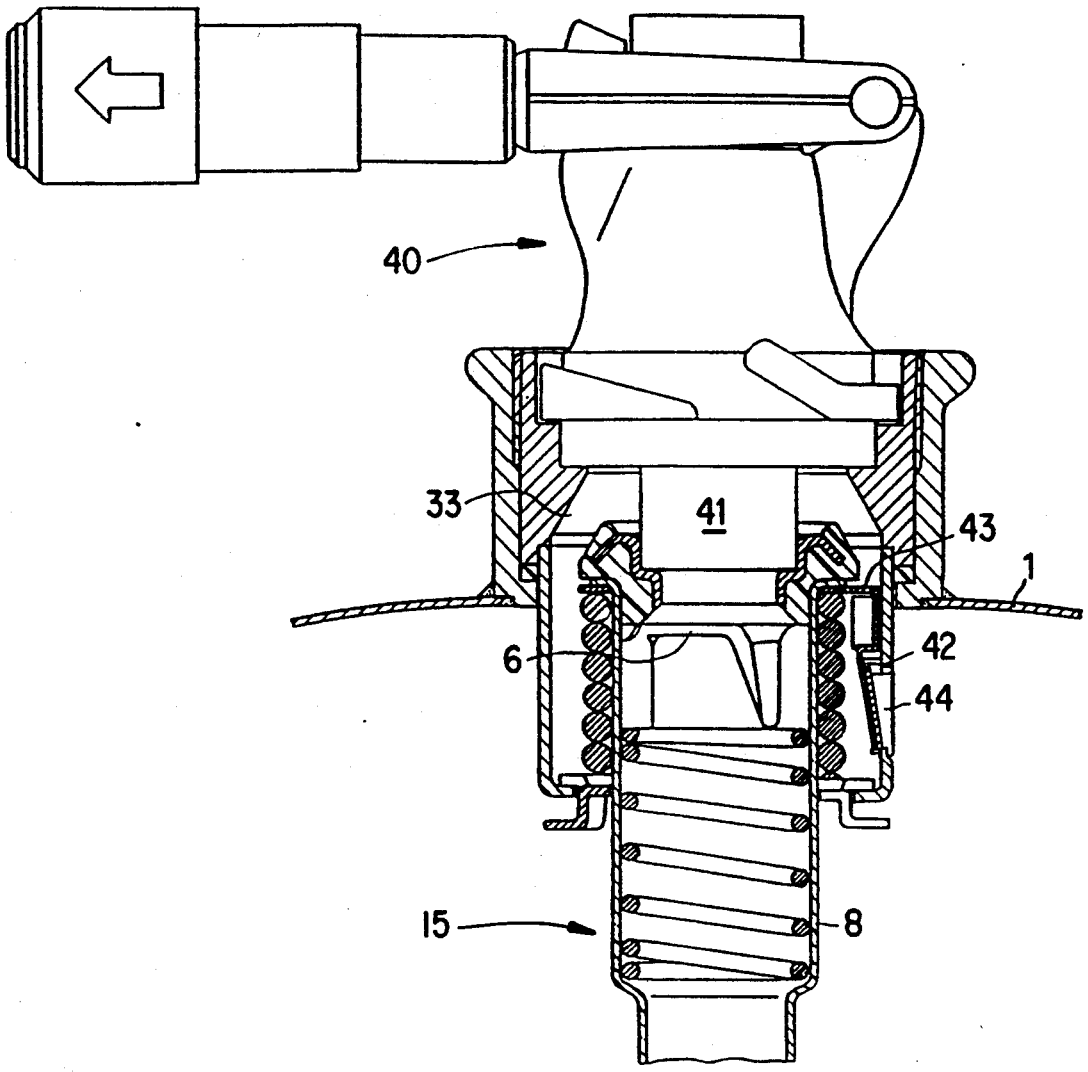
Figure 11:
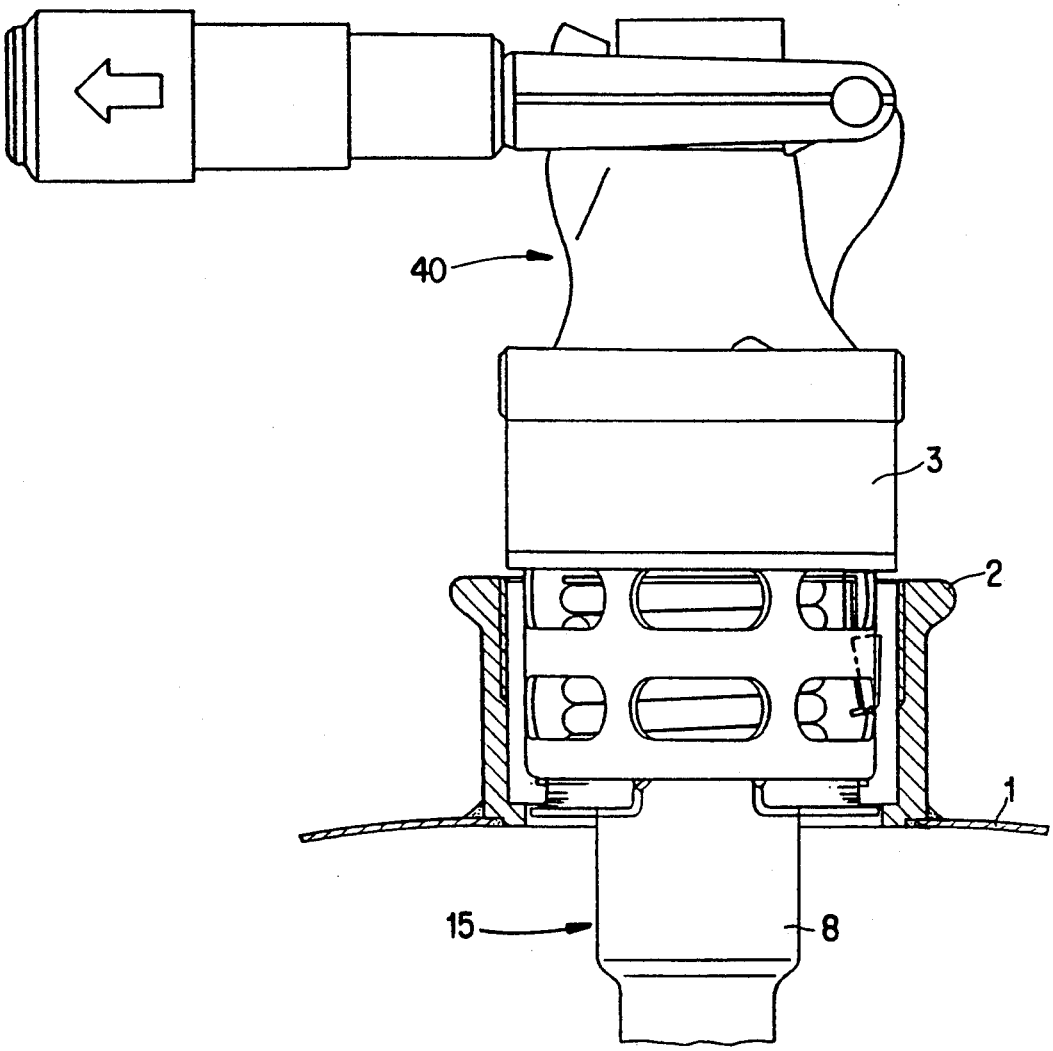
Figure 12:
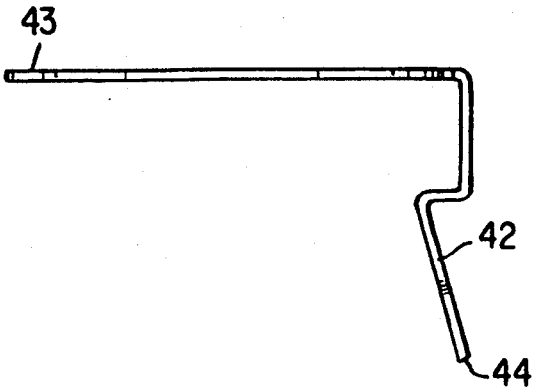
Figure 13:
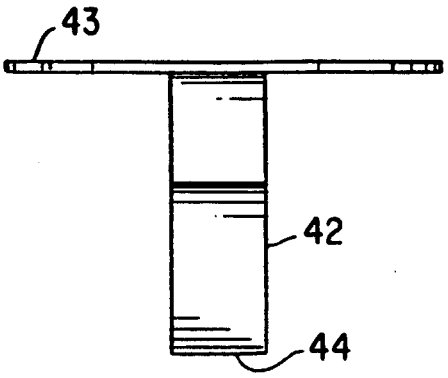
Figure 14:
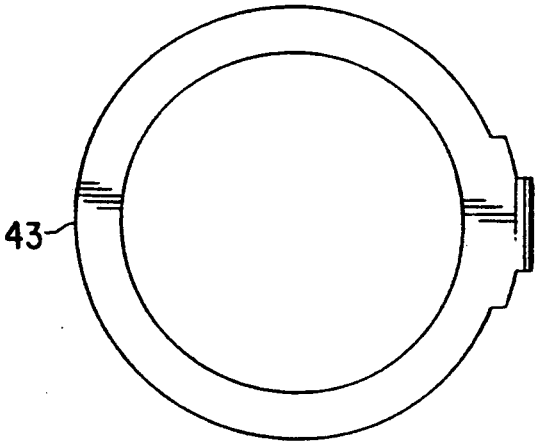
Figure 15:
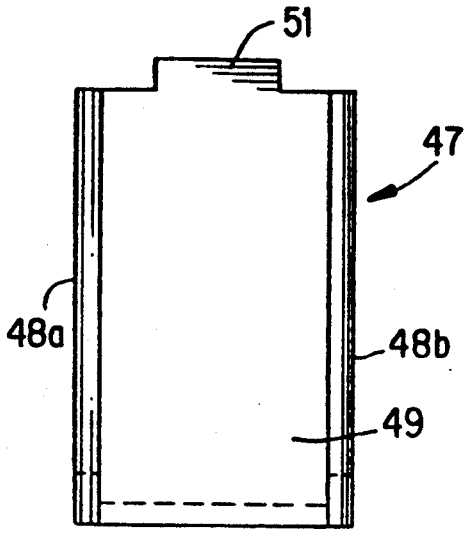
Figure 16:
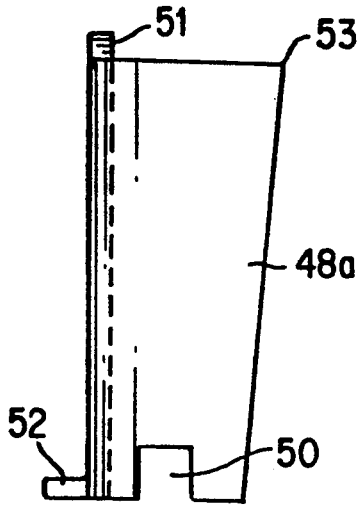
Figure 17:
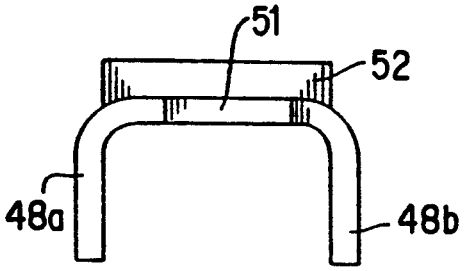

The invention will be explained more fully by the following description of embodiments, given by way of example, with reference to the drawing, in which FIG. 1 shows a section through a first embodiment of a valve arrangement according to the invention, FIG. 2 is a perspective exploded view of the arrangement shown in FIG. 1, FIG. 3 shows the arrangement of FIG. 1 with a mounted coupling head so activated that the riser pipe part is pressed down to its lower open position, FIG. 4 shows the arrangement of FIG. 1, but with the riser pipe part now forced to the bottom position by means of a mounted special tool, FIG. 5 shows the valve during dismounting with the riser pipe part in the position shown in FIG. 4, FIG. 6 is a lateral view of a finger associated with the embodiment shown in FIGS. 1-5 and having a ring for securing the finger on the riser pipe part, FIG. 7 is a top view of the same, FIG. 8 is a section through another embodiment of a valve arrangement according to the invention, FIG. 9 shows the same, but with a mounted coupling head which is activated and has thereby pressed the riser pipe part down to its lower open position, FIG. 10 shows the arrangement of FIG. 8, but where the riser pipe part is no forced down to the bottom position by means of a mounted special tool, FIG. 11 shows the same, but with the valve now in a dismounting position, FIG. 12 is a lateral view of a finger associated with the embodiment shown in FIGS. 8-11, and having a ring for securing the finger on the riser pipe part, FIG. 13 is a front view of the same, FIG. 14 is a top view of the same, FIG. 15 is an end view of the catch associated with the embodiment shown in FIGS. 8-11, FIG. 16 is a side view of the same, and FIG. 17 is a top view of the same.

FIGS. 1-7 show a first embodiment of a valve arrangement according to the invention. In FIG. 1, this arrangement is mounted in a stub 2 which is welded in an opening upwardly in a container 1, of which only a fraction is visible. The container 1 is a pressure container and, as indicated, therefore has a coupled bottom for better withstanding the internal positive pressure, and according to the purpose for which the container is to be used, it may be manufactured from stainless steel, aluminium, plastics or another suitable material.

The valve, which is generally designated by 12, and whose individual components are clearly shown separately in FIG. 2, consists of a valve housing 3, which by means of a threaded joint 13, is screwed firmly down against a ring gasket 4 which is arranged on an internal collar 14 in the stub 2 and forms a seal between said collar and the valve 12. A riser pipe part is mounted co-axially in the valve housing 3, said riser pipe part being generally designated by 15 and comprising a riser pipe 8, of which only the upper part is visible, and a valve ring 5, which is arranged at the top of the riser pipe 8 and is supported by an outwardly directed collar 16 on it.

The valve ring 5 consists of an elastic material, e.g. rubber in which a reinforcement disc 17 is embedded to stabilize the shape of the valve ring 5. Internally, the valve ring 5 has an opening 18 forming the liquid passage of the valve 12, which, when the valve is not activated, is kept closed by a valve plug 6 which, by means of a compression spring 7 arranged inside the riser pipe 8, is pressed inwardly against a seat 59 provided downwardly in the opening 18 of the valve ring 5. This internal compression spring 7 in turn rests with its lower end against an internal shoulder 19 in the riser pipe 8.

Externally, the valve ring 5 has a conical face 20 which, when the valve is not activated, is kept engaged with a conical seat 21 in the valve housing 3 by means of an external compression spring 10, which imparts an outwardly directed compression force to the underside of the valve ring 5 via a disc 31 and the outwardly directed collar 16 of the riser pipe 8. The lower end of the external compression spring 10 is supported by a wave-shaped locking ring 11, which rests on a plurality of inwardly bent flaps 32, each of which engages with a corresponding wave trough 22 in the locking ring 11, causing the locking ring to lock the various components of the valve 12 together to an assembled unit.

In FIG. 3, a coupling head, generally designated by 24, is fixed upwardly in the valve housing 3 by means of coupling pins 23. This coupling head 24 serves partly to add propellant gas to the container 1 via a gas inlet 25, partly to discharge the liquid in the container via a liquid outlet 26. The gas, which may e.g. be $CO_2$, is added from a pressure bottle or pressure cartridge via a gas conduit, and the liquid from the outlet 26 is passed via a liquid conduit futher on to a dispensing location. The last-mentioned parts belong to the prior art and are not shown in the drawing. The liquids to be stored and transported in such transportable containers under pressure from a propellant gas may e.g. be liquids for consumption, such as beer, mineral water and wine, or liquids used in the industry or agriculture, e.g. pesticides for combatting pests and weeds.

The coupling head 24 has a handle 27, which can be pivoted about a shaft 28 between an upper position where the valve is closed, and a lower position where the valve is open. In FIG. 3, the handle 27 is in the lower position where, by means of an axially displaceable hollow spindle 29 terminating upwardly in the liquid outlet 26, the handle has moved the riser pipe part 8 from the upper closed valve position shown in FIG. 1 to the lower open valve position shown in FIG. 3, the internal conical seat 21 in the valve housing 3 and the external conical face on the valve ring 5 defining between them a gas passage 33 for the propellant gas, which can then flow into the interior of the container 1 through this passage and openings 34 in the lower part of the valve housing 3. At the same time the valve plug 6 is pressed downwardly in the riser pipe 8 by means of a constricted hollow elongation of the spindle 29 on the coupling head 24 while overcoming the spring force of the internal compression spring 7. A liquid passage 35 is hereby defined between the seat 59 of the valve ring 5 and the valve plug 6, said liquid passage 35 connecting the interior of the hollow spindle 29 with the riser pipe 8 via cutouts 36 in the constricted elongation 37, said riser pipe 8 being emersed in the liquid so that said liquid, when it is to be used, can be discharged from the container 1 via the liquid outlet 26 under the action of the pressure from the propellant gas.

As mentioned before, the valve 12 is merely mounted in the stub 2 by means of a simple threaded joint 13 in the shown arrangement. Instead, also other connection types might be used, which, however, like the threaded joint enables anyone to dismount the valve readily, if no special safety measures have been taken to prevent this. However, dismounting while positive pressure still prevails in the container may cause considerably damage since the pressure, when the threaded joint is disengaged from the valve, will drive it with a great force into the surroundings where the valve may e.g. hit the person who bent over the container is at work dismounting the valve.

To eliminate this risk, a finger 9 shown on an enlarged scale in FIGS. 6 and 7 is mounted on the riser pipe 8. This finger 9 is upwardly secured to the ring-shaped disc 31, which is fixed between the upper end of the internal compression spring 7 and the outwardly directed collar 16 on the riser pipe 8. The finger 9 extends obliquely downwardly from the ring 31 in the interior of the lower part of the valve housing 3, and downwardly the finger has a U-shaped bend 38 which terminates in a stop member 39 protruding radially outwardly with respect to the axis of the riser pipe outside the lower part of the housing 3. This stop member 39 is so spaced from the top and axis of the riser pipe part that the stop member 39, both in the closed valve position shown in FIG. 1 and in the open valve position shown in FIG. 3, abuts the underside of the stub 2 if it is attempted to dismount the valve, so that the valve can no longer be removed completely from the container. Simultaneously with the dismantling attempt, the pressure in the container is blown off through the opening which is formed during said attempt between the gasket 4 and the underside of the valve housing 3, so that the container 1 is now in a state which does not involve any risks of the above-mentioned type.

In FIG. 4 the coupling head 24 is replaced by special tool 40, which may be similar to the coupling head 24 shown in FIG. 3, but has a spindle 41 which is longer than the spindle 29 of the coupling head 24 and moreover lacks the constricted elongation 37 of said spindle 29. In the lower open valve position shown in FIG. 3, the external compression spring 10 has still not been compressed completely together, and the riser pipe 8 can therefore be moved additionally downwardly until it reaches the lower bottom position shown in FIG. 4 where the coils of the spring 7 are closely spaced from one another. This lower bottom position is reached when the handle 27 is pivoted down to its lower position shown in FIG. 4, the length of the spindle 41 exceeding that of the spindle 29 precisely by the amount which the spring 10 can be compressed additionally together with respect to the length which the spring has in the lower open valve position, which is shown in FIG. 3.

Together with the riser pipe 8, the finger 9 and thereby the stop member 39 are moved down to the lower bottom position where, however, the stop member 39 is displaced so far vertically downwardly with respect to the housing 3 that the valve 12, as shown in FIG. 5, can now be moved out through the opening of the stub 2, without the stop member 39 hitting the underside of the stub 2 or any other part of it. If desired, the spindle 41 may be solid, so that by itself it blocks discharge of liquid during dismounting, but it may also be hollow like the spindle 29 since it lacks the elongation 37 of said spindle 29 and therefore does not open the liquid passage 35 when the handle 37 is pivoted down to its lower position. Moreover, like the coupling head 24, the special tool 40 may be provided with a gas channel (not shown), through which the positive pressure in the container will then immediately be blown off when the handle 29 is activated and the gas passage 33 of the valve is thereby opened.

FIGS. 8–17 show another advantageous embodiment of the valve arrangement of the invention which, apart from the safety mechanism, essentially corresponds to the first embodiment shown in FIGS. 1–5, and the same reference numerals as in FIGS. 1–5 are therefore used in FIGS. 8–11.

In this case the finger 42, which is shown on an enlarged scale in FIGS. 12, 13 and 14, consists of an elastic material, e.g. spring steel, which may also be corrosion-resistant if desired. The finger 42 is secured to a ring 43, which may be of the same elastic material as the finger 42, and which, like the ring 31, is fixed between the upper end of the external compression spring 10 and the outwardly directed collar 16 of the riser pipe 8. Downwardly the finger has a lower free edge 44 which is forced outwardly by a biassed spring force in the finger 42 against the inner side of a lower part of the wall 45 of the valve housing at a place located somewhat downwardly in the container 1. An opening 46, in which a catch 47 is arranged, is provided at this place.

This catch 47, which is shown on an enlarged scale in FIGS. 15, 16 and 17, has the shape of a U in vertical section, said U having two flaps **48*a*, 48*b* directed outwardly with respect to the valve axis and a bottom plate 49 forming the inner side which faces the finger 42. The lower edge of each of the flaps 48*a*, 48*b* is formed with a cutout 50, which, when the catch is mounted in the opening 46, receives part of the lower edge of said catch so as to form a tiltable bearing permitting the catch to tilt from a first position (FIGS. 8 and 9) where the catch is tilted outwardly with respect to the wall 45 of the housing, and a second position (FIGS. 10 and 11) where the outer side of the catch is substantially flush with the outer side of this wall 45. Upwardly, the bottom plate 49 merges into a stop flap 51 serving to stop the outward tilting of the catch when the catch has reached its first position. Downwardly, the bottom plate 49 moreover has an inwardly directed projection 52**, whose importance will be explained more fully below.

In FIG. 8 the valve 12 has been screwed into the stub 2, and the riser pipe part 15 is present in its upper closed valve position where the lower free edge 44 of the elastic finger 42 rests against the inner side of the catch 47 and thereby tilts it out to its first position. In FIG. 9, a coupling head 24 has been mounted on the valve 12. In the shown situation, the handle 27 of the coupling head has been pivoted down to its lower position, whereby the riser pipe part 15 has been moved down to its lower open position. The catch 47 is still held in its first position by the finger 42. However, in this first position the upper outer edge 53 of the catch is so radially spaced from the outer side of the housing wall 45 that the catch will abut the bottom of the stub 2 if it is attempted to dismount the valve. Thus, the valve cannot readily be dismounted in either the closed valve position shown in FIG. 8 or in the open valve position shown in FIG. 9, and this is an effective safeguard against damage which might occur as a consequence of unauthorised persons' attempt to dismount the valve.

In FIG. 10, the coupling head 24 has been replaced by the special tool 40 mentioned in connection with the description of the first embodiment of the valve arrangement according to the invention. The operating handle 27 of the tool has been pivoted to its lower position, whereby the riser pipe part 15 has been moved down to its lower bottom position. At the same time the finger has been moved a corresponding distance downwardly and now treads with its lower free edge 44 on the inwardly directed projection 52 on the catch 47, whereby this has been tilted into its second position. In this second position the outer side of the catch is substantially flush with the outer side of the housing wall 45, and the valve 12 can now readily be dismounted since the valve can freely pass the opening of the stub 2, as shown in FIG. 11.

The second embodiment of the valve arrangement according to the invention described above has just one finger with associated catch. However, for safety improving purposes, the arrangement may be provided with one or more additional fingers with associated catches.

We claim:

1. A valve arrangement for a transportable container of the type serving to store and distribute a liquid under pressure from a propellant gas, said arrangement comprising a ring-shaped stub secured in an opening upwardly in the container and a double valve having both a blockable gas passage and a blockage liquid passage and substantially consisting of a valve housing, which can be detachably mounted in the stub, and a riser pipe part arranged co-axially with an upper reception area in the valve housing such that said riser pipe part can be displaced axially from an upper closed valve position to a lower open valve position against the pressure from a spring mounted in the valve housing, wherein the riser pipe part can be displaced additionally a distance axially downwardly from the lower open position to a lower bottom position, and the riser pipe part mounts an outwardly protruding finger of an elastic material with a free end part so spaced from the top and axis of the riser pipe part that a mounted valve can be dismounted only in and in the vicinity of the bottom position, wherein the finger is adapted with such a spring force that the free end part of the finger is forced out towards the inner side of a lower part of the valve housing wall, and that a catch is arranged in an opening in the lower part of the valve housing wall, said catch having downwardly an inwardly directed projection and being capable of tilting about the lower edge of the opening between a first position where the upper outer edge of the catch protrudes so far from the wall of the housing that, when it is attempted to dismount the valve, it abuts the underside of the stub in all positions of the riser pipe part, except in and in the vicinity of the bottom position, and a second position where the outer side of the catch is substantially flush with the outer side of the wall, said finger having such a length that a free end part of said finger rests against the inner side of the catch in all riser pipe part positions and thereby tilts the catch out to its first position, except in and in the vicinity of the bottom position where the free end part treads on the inwardly directed projection on the catch and thereby tilts it inwardly to its second position.

2. A valve arrangement according to claim 1, wherein a substantially vertical section of the catch has a U-shape with two flaps directed outwardly with respect to the axis of the valve and a bottom plate forming the inner side of the catch, and that the inwardly directed projection consists of an edge which is bent inwardly downwardly on the bottom plate, while a tiltable bearing of the catch consists of cuttouts which are provided in the lower edges of the outwardly directed flaps and serve, in mounted state, to receive part of the lower edge of the valve wall opening.

3. A valve arrangement according to claim 1, wherein the finger is upwardly secured to a ring, which is fixed between the spring and an outwardly directed collar provided upwardly on the riser pipe part.

* * * * *